US011370642B2

(12) United States Patent
Markwell

(10) Patent No.: US 11,370,642 B2
(45) Date of Patent: Jun. 28, 2022

(54) APPARATUS FOR CONTROLLING ORIENTATION OF SUSPENDED LOADS

(71) Applicant: ROBORIGGER PTY LTD, West Perth (AU)

(72) Inventor: Derick Markwell, West Perth (AU)

(73) Assignee: ROBORIGGER PTY LTD, West Perth (AU)

( * ) Notice: Subject to any disclaimer, the term of this patent is extended or adjusted under 35 U.S.C. 154(b) by 204 days.

(21) Appl. No.: 16/462,813

(22) PCT Filed: Nov. 21, 2017

(86) PCT No.: PCT/AU2017/051277
§ 371 (c)(1),
(2) Date: May 21, 2019

(87) PCT Pub. No.: WO2018/090104
PCT Pub. Date: May 24, 2018

(65) Prior Publication Data

US 2019/0375615 A1 Dec. 12, 2019

(30) Foreign Application Priority Data

Nov. 21, 2016 (AU) ..... 2016904755
Aug. 2, 2017 (AU) ..... 2017903055

(51) Int. Cl.
*B66C 13/00* (2006.01)
*B66C 13/08* (2006.01)
(Continued)

(52) U.S. Cl.
CPC ..... *B66C 13/08* (2013.01); *B66C 1/10* (2013.01); *B66C 13/04* (2013.01); *B66C 13/06* (2013.01);
(Continued)

(58) Field of Classification Search
CPC ..... B66C 13/08; B66C 13/04; B66C 13/06; B66C 13/16; B66C 13/40; B66C 13/46; B66C 1/10
(Continued)

(56) References Cited

U.S. PATENT DOCUMENTS 2,736,600 A 2/1956 Carlson
3,210,114 A * 10/1965 Lawton ..... B66C 13/08 294/81.4
(Continued)

FOREIGN PATENT DOCUMENTS

CN 102791608 A 11/2012
CN 105793186 A 7/2016
(Continued)

OTHER PUBLICATIONS

Search report for EP17870790-7 dated Jun. 23, 2020.
(Continued)

*Primary Examiner* — Emmanuel M Marcelo
(74) *Attorney, Agent, or Firm* — Hahn Loeser & Parks LLP; Bret A. Hrivnak

(57) ABSTRACT

A rotator apparatus (10, 100, 200) for rotationally positioning a suspended load (16). A flywheel (44, 144) can be directly or indirectly driven by a motor (40, 140). Vanes (50, 150) on a fan (45) or on the flywheel can be used to provide additional rotational control through air resistance/braking. A controller (20, 24, 120, 124) can provide wired or wireless control. Thrusters (52) can provide additional rotational impetus or resistance. One or more load cells (54, 232, 234) can provide load sensing. Cameras (28) can be used to visualise the load and can record load moving operations and details of the load for logistics tracking and safety. The attachment part (202) and/or the load support (216) can be connected to the body via a respective pivot (204, 214). The
(Continued)

apparatus can include replaceable or rechargeable batteries (206, 210), such as within in a removable container (230), preferably supported by at least one drawer (231), which drawer may be mounted on telescopic drawer slides (212). The replaceable or rechargeable batteries (206, 210) can be provided as a cassette arrangement whereby the batteries plug in and are removable as a unit. At least one hook (157) for suspending a load from the rotator can include a groove or recess (158) to restrict or prevent load rotation.

38 Claims, 4 Drawing Sheets

(51) Int. Cl.

| | |
|---|---|
| ***B66C 1/10*** | (2006.01) |
| ***B66C 13/06*** | (2006.01) |
| ***B66C 13/16*** | (2006.01) |
| ***B66C 13/40*** | (2006.01) |
| ***B66C 13/46*** | (2006.01) |
| ***B66C 13/04*** | (2006.01) |

(52) U.S. Cl.
CPC ..... *B66C 13/16* (2013.01); *B66C 13/40* (2013.01); *B66C 13/46* (2013.01)

(58) Field of Classification Search
USPC ..... 212/272; 294/81.4; 700/228
See application file for complete search history.

(56) References Cited

U.S. PATENT DOCUMENTS

| | | | | | |
|---|---|---|---|---|---|
| 3,498,476 | A * | 3/1970 | Jettman | B66C 13/08 | 414/754 |
| 3,608,384 | A * | 9/1971 | Hardin | B66C 13/08 | 74/5.22 |
| 3,799,358 | A * | 3/1974 | Putnam | B66C 13/08 | 212/285 |
| 5,632,222 | A | 5/1997 | Fido | | |
| 5,816,098 | A * | 10/1998 | Kanki | B66C 13/08 | 74/5.22 |
| 5,871,249 | A * | 2/1999 | Williams | B66C 13/08 | 294/86.41 |
| 8,226,042 | B1 | 7/2012 | Howell et al. | | |
| 8,938,325 | B1 * | 1/2015 | McGinnis | B66C 13/08 | 701/4 |
| 9,896,311 | B2 * | 2/2018 | Bang | B66C 1/10 | |
| 2012/0328408 | A1 | 12/2012 | Sorenson et al. | | |
| 2016/0297650 | A1 | 10/2016 | Bang | | |
| 2017/0129749 | A1 * | 5/2017 | Rodr | B66C 13/08 | |
| 2018/0251346 | A1 * | 9/2018 | Thomson | B66C 13/08 | |
| 2020/0271270 | A1 * | 8/2020 | Sikora | F16B 2/12 | |
| 2021/0078837 | A1 * | 3/2021 | Sikora | B66C 13/46 | |

FOREIGN PATENT DOCUMENTS

| | | | | | |
|---|---|---|---|---|---|
| GB | 993269 | | 5/1965 | | |
| GB | 993269 | A | 5/1965 | | |
| GB | 2544513 | A * | 11/2015 | B66C 13/08 | |
| JP | S47026629 | | 7/1972 | | |
| JP | S5233243 | | 3/1977 | | |
| JP | S5554284 | | 4/1980 | | |
| JP | S63134495 | | 6/1988 | | |
| JP | H09110362 | | 4/1997 | | |
| JP | H09136786 | A | 5/1997 | | |
| JP | H09309687 | A | 12/1997 | | |
| JP | 2004210518 | | 7/2004 | | |
| JP | 2016210607 | A | 12/2016 | | |
| WO | 2015082347 | A1 | 6/2015 | | |

OTHER PUBLICATIONS

International Search Report and Written Opinion for PCTIAU2017/051277 dated Dec. 21, 2019.
Japanese Notice of Refusal regarding JP2019547742, dated Nov. 2, 2021 with English Translation (20 pgs.).

* cited by examiner

APPARATUS FOR CONTROLLING ORIENTATION OF SUSPENDED LOADS

FIELD OF THE INVENTION

The present invention relates to apparatus for controlling orientation of a suspended load.

The present invention particularly relates to apparatus for controlling yaw orientation of a suspended load.

The present invention is applicable to apparatus for controlling yaw orientation of a load suspended in air or water.

BACKGROUND TO THE INVENTION

There is often a requirement for hoisting or lowering a suspended load. Some loads are extremely heavy, other loads are very long (such as for civil engineering projects e.g. girders and beams for building and bridge construction), and some loads are often both heavy and long.

The apparatus may allow a load to be remotely disconnected from the apparatus. For example, the apparatus may include and use a remotely actuated load release mechanism, such as a remotely controlled release hook, allowing release of the load to ensure personnel are at a safe distance when the load is released or to disconnect rigging by which the load is suspended from the apparatus.

Physically large suspended loads can be affected by side winds, causing the load to rotate if uncontrolled.

Control ropes can be attached to the load and held by one or more personnel to help control the rotational orientation of the suspended load.

However, such operations put the personnel at risk of injury from the load unexpectedly rotating or falling. Serious injuries and deaths have occurred whereby personnel steering orientation of the suspended load with guide ropes have been accidentally crushed by the load.

Some suspended loads require extremely careful positioning, such as stretchers and rescue personnel suspended from a cable deployed from a helicopter, or loads that have to be attached/fitted to existing structures such as steel trusses, wall panels or components of a tower crane.

In addition, elongate flexible cables are naturally subject to torque that can result in the suspended load spinning, particularly if there are buffeting side winds affecting the load.

One arrangement for stabilising rotational orientation of a suspended load is disclosed in United States of America patent document U.S. Pat. No. 5,632,222, which describes a load orientating device comprising a flywheel mounted in a flywheel housing for rotation about an axis such that, in use, the flywheel is able to rotate only in a single plane, drive means for rotating the flywheel, turntable means pivotally connected to said housing for selective rotation about a second axis and adapted to be secured to said load and second drive means fixed relative to the housing for rotating said turntable means.

An alternative arrangement for controlling orientation of a suspended load is disclosed in United States of America patent document U.S. Pat. No. 5,871,249 which describes a stabilizer, control unit and positioner located above a suspended payload. The stabilizer includes a plurality of flywheels within a casing. The axis of rotation of each flywheel is aligned with one of three orthogonal axes. A central bevel gear translates the output of a high rpm motor to the various flywheels. Four flywheels are arranged into two counter-rotating pairs along one horizontal axis. Two flywheels counter-rotate about the other axis and a single flywheel rotates about the vertical axis. The mass and arrangement of flywheels provides gyroscopic stability while neutralizing potential precessional moments.

An alternative arrangement for controlling spin/yaw of a suspended load is disclosed in United States of America patent document U.S. Pat. No. 8,226,042 which describes use of first and second thrusters acting in opposite directions and both acting perpendicular to a suspension cable, and a controller controlling thrust from each thruster to maintain yaw orientation of the suspended payload.

A subsequent patent document U.S. Pat. No. 8,938,325 seeks to improve upon the arrangement disclosed in U.S. Pat. No. 8,226,042 by providing a system which compensates for environmental factors, cable spring, and damping factors that affect spin and pitch changes or system noise from the thrusters, winches, helicopter or other system noise that affects the ability of the control system of U.S. Pat. No. 8,226,042 to operate effectively.

With the aforementioned background in mind, which has limitations, it has been found desirable to provide an apparatus for improving control of orientation of a suspended payload.

SUMMARY OF THE INVENTION

The present invention provides an apparatus which, when connected between a suspension line and a suspended load, provides a controlled rotational torque and controls yaw position of the suspended load.

With the aforementioned in view, an aspect of the present invention provides a rotational orientation control apparatus for controlling rotational orientation of a load suspended from the apparatus, the apparatus including a rotator having at least one flywheel, at least one respective flywheel drive means, and a control means, control of the at least one flywheel providing a respective proportion of reaction torque for controlling rotational orientation of the suspended load.

The apparatus may include at least one fan. Preferably, the fan or each fan may be mounted to, or form part of, a respective flywheel.

The apparatus may include at least one gyroscope.

It will be appreciated that the apparatus and/or the suspended load preferably has no attached lines (other than the suspension line) or structural restraints to withstand the reaction force created by the apparatus.

Preferably the apparatus may be controlled wirelessly from a remote device. However, the apparatus may alternatively be controlled by via a connected control cable.

The apparatus may include at least one flywheel and/or at least one fan system and/or at least one gyroscope for use in controlling rotational torque to control rotational orientation of the suspended load.

Rotational torque generated by the apparatus may be provided by one of, or a combination of two or more of, a) reaction against flywheel inertia, b) thrust from a fan system c) reactions provided by the precession of gyroscopes.

The apparatus may preferably include at least one camera. The at least one camera may be provided for monitoring the suspended load and/or the physical space around the load or location below the load. The camera may be used to capture an image of the suspended load and/or one or more of a hook, a release mechanism and a spreader bar by which the load is connected to the rotator apparatus. Image recognition techniques may be used to positively identify the load and/or one or more characteristics of the load (such as evenness of balance, wrapping or fasteners around the load, signs of slippage of part or all of the load, identification of markers (such as barcodes or labelling), and/or for one or more markers/indicators for the purposes of logistics tracking.

The apparatus may include a release mechanism, which may include or utilise one or more hooks. The release mechanism may be remotely actuated/operated. The release mechanism may be operated to disconnect the apparatus and load from each other, such as on the command of a signal received by wireless receiver or via a connected cable. One or more of the hooks may incorporate a groove or recess in the bend of the hook e.g. in the bend between the shank and the tip of the hook. The groove or recess can positively locate a connector (such as a shackle or link) supporting/connecting the load from the hook and restricting or preventing rotation between the hook and the connector (e.g. link or shackle.) The groove or recess may be provided at a widened/thickened portion of the bend of the hook. For example, the bend of the hook may have a portion that widens/flares outwards such that a base of the recess or groove is wider than portions of the hook immediately prior to and/or after the flared portion.

One or more forms of the present invention provide(s) a motor providing torque to at least one flywheel. Such torque may be provided through gearing between the motor and the at least one flywheel, or by direct connection of the motor to the flywheel, or by incorporating the motor elements into the at least one flywheel.

The apparatus may include at least one fan. For example, one or more vane fans may be provided.

Where one or more embodiments of the present invention is employed underwater or partially submerged/immersed in water, at least one impeller may be provided to replace or augment the at least one fan.

The function of the components of the invention under/within water is similar to the function of the components above water except that the magnitude of the forces on the immersed components is different due to the physical differences between water and air.

A fan is preferably attached to or forms part of the or each respective flywheel.

The at least one fan may include a number of vanes. Air moved by the fan(s) provides a reaction force creating a reaction torque on the fan(s) and therefore on the associated flywheel(s), which is particularly effective at high flywheel rotational speeds augmenting or replacing a change of flywheel speed to induce reaction torque to control the rotational orientation of the payload.

One or more flywheels of the apparatus may incorporate a number of the vanes, which may preferably include, or be, radial vanes.

At least one moveable vane may be provided to modify/control airflow from the fan(s), and thereby be used to control the rotational orientation of the suspended load.

The moveable vanes may be mounted on the fan or may be mounted off the fan to guide airflow from the fan. The vanes may automatically adjust to change the direction of air deflection when the rotation direction of the fan reverses.

The apparatus may include at least one thruster. The thruster, or more than one thruster, may be mounted external to a housing of the rotator to provide rotational thrust or additional rotational thrust to rotate or control rotation of the suspended load to adjust yaw position and/or rate of yaw.

It will be appreciated that yaw relates to the rotation of the suspended load about an upright/vertical axis (often called the 'z' axis)

The thruster, or each thruster, may be mounted on the outside of the rotator housing or may be mounted independently on a lifting device (such as a lifting beam) attached to the rotator. Alternatively, or in addition, the thruster(s) may be attached to the suspended load.

Operation of the thruster(s) can be controlled by the controller.

The thruster(s) may include one or more of a propeller, a turbo fan, a shrouded fan or compressed gas jet thruster, or combinations of two or more thereof.

The apparatus may include at least one gyroscope, preferably two gyroscopes, to provide additional torque about a vertical axis by tilting their respective axis of spin.

The apparatus may include at least one load cell such that the weight of the lifted load and/or balance of weight between lifting points is provided to the remote operator and to the control system.

A control system may be provided. The apparatus may include a control system, which may include one or more of a) a microcomputer; b) a 9 axis inertial sensor containing accelerometers, gyros and magnetometers for each of the three principal axes x,y,z; c) an encoder input or other feedback system from the motor variable speed controller that senses the flywheel speed; d) interface to a motor variable speed controller; e) wireless (wifi or other wireless system) interface; f) interface to load cell (if a load cell is used); g) interface to remote release hooks (if provided); h) interface to thrusters (if used); i) interface to centrifugal fan air guide vanes (if used) and j) one or more GPS sensors. The apparatus may include or be in communication with an independent wireless system for video communication.

The three principal axes are usually termed the roll axis or 'x' axis, the pitch axis or 'y' axis and the yaw or 'z' axis for a body such as a payload or a vehicle.

The apparatus may include adaptive control system/logic to allow the suspended load to be rotated to an orientation defined by the operator and to maintain the load in that orientation. The adaptive control system/logic may respond to or react to torsional stiffness of the connection between the load and the apparatus. The adaptive control system/logic may respond to the mass of the load as determined by the load cell.

The at least one flywheel may include a solid or aperture disc flywheel. Preferably the solid or aperture disc flywheel concentrates mass of the flywheel toward its perimeter. Preferably the at least one flywheel includes a machined disc.

Alternatively, or in addition, the at least one flywheel may include a centreless flywheel, an annular flywheel or a ring type flywheel, which flywheel may preferably be driven through an internal or external ring gear of the flywheel. For example, the ring gear may be provided on one or both of the external and internal faces of the annular or ring flywheel.

The at least one flywheel may be driven by a motor. The motor may be connected by means of a belt or chain drive system to drive the at least one flywheel. The at least one flywheel may be driven by a motor with a hollow shaft that is attached to the flywheel or which uses the flywheel to support the rotor elements of the motor.

The centreless, annular or ring type flywheel can be guided and/or supported by bearings. The bearings can support the annular or ring type flywheel at a lower face and/or outer/inner face of thereof.

One or more motors, preferably electric motors, can drive the ring gear, such as through a drive gear or gearing.

It will be appreciated that a centreless, annular or ring type flywheel allows for a centralised lifting load path through the centre of the apparatus.

A further aspect of the present invention provides a rotational orientation control apparatus for controlling rotational orientation of a load suspended from the apparatus, the apparatus including a rotator having at least one flywheel, at least one respective flywheel drive means, and a control means, control of the at least one flywheel providing a respective proportion of reaction torque for controlling rotational orientation of the suspended load, wherein, the at least one flywheel includes a solid, centreless, annular or ring type flywheel.

Preferably, one or more embodiments of the present invention includes a combination of solid, aperture and/or centreless/annular/ring type flywheels.

More preferably, the at least one flywheel may be selected for use in the apparatus to suit a particular application or specification.

The apparatus may include a swivel at the support where the apparatus is suspended from a supporting line, such as a supporting line from a crane hook. Such a swivel preferably allows free rotation about a vertical axis.

At least one pivot can be provided that allows the apparatus to tilt, such as, for example, in the plane of symmetry of the load that is generally defined by the swivel and two lifting points used for connecting the load to the apparatus. 33. The apparatus according to any one of the preceding claims, including at least one pivot, each said pivot having a respective pivot axis. The apparatus may include at least one said pivot connected between a body of the apparatus and a suspension line from which the rotator is suspended and/or at least one said pivot connected between the rotator and a load suspended from the body of the apparatus. The at least one pivot may allow the rotator to tilt about the respective pivot axis relative to the load and there is little or no moment on the rotator about an axis perpendicular to the rotation axis of the rotator. The pivot axis of at least one said pivot connected between rotator and a suspension line from which the rotator is suspended and a pivot axis of the at least one said pivot connected between the rotator and a load suspended from the rotator may be parallel to one another.

The load may be attached to one or more lifting points on an underside of the apparatus, such that rotational torque can be applied to the load through the lifting rigging.

Where a single lifting point is used, a rotationally rigid structure (such as a spreader bar or frame) can be employed. Multiple cables/chains/wires can be attached to the rotationally rigid structure in order to transfer the rotational torque to the load.

An alternative configuration may have the load directly or indirectly connected to the single lifting point in a manner that the lifting point is able to transmit rotational torque through the connections into the load.

The apparatus may include a single point attachment that connects multiple lifting points to the apparatus such that the projection of the axis of the swivel passes through this single point.

A motor controlling system may be provided that allows energy stored in the rotating flywheel to be converted back into electrical power when it is required to decelerate the flywheel. This electrical power that can be used to charge the battery.

The remotely operated load release system may include one or more than one safety feature to ensure that the load cannot be released accidentally. For example, one or more safety features may include a control arrangement that requires two buttons to be pressed simultaneously in order to initiate load release and/or an arrangement that uses a load cell to determine if a load is still being supported by the apparatus and/or an arrangement that is unable to operate the release if the load on the attachment is greater than a pre set amount (load limit sensing to prevent release). One or more forms of the present invention may include overload detection system which detects overload if the weight and/or balance of the load is/are beyond a respective weight or balance threshold.

The apparatus may be powered using batteries, (such as replaceable and/or rechargeable batteries) contained in a removable container or in a drawer so that they can be quickly changed in order to allow continuous use of the apparatus by exchanging the discharged battery pack with a charged battery pack.

BRIEF DESCRIPTION OF THE DRAWINGS

One or more embodiments of the present invention will hereinafter be described with reference to the accompanying drawings, in which.

DESCRIPTION OF PREFERRED EMBODIMENT

Figure 1:
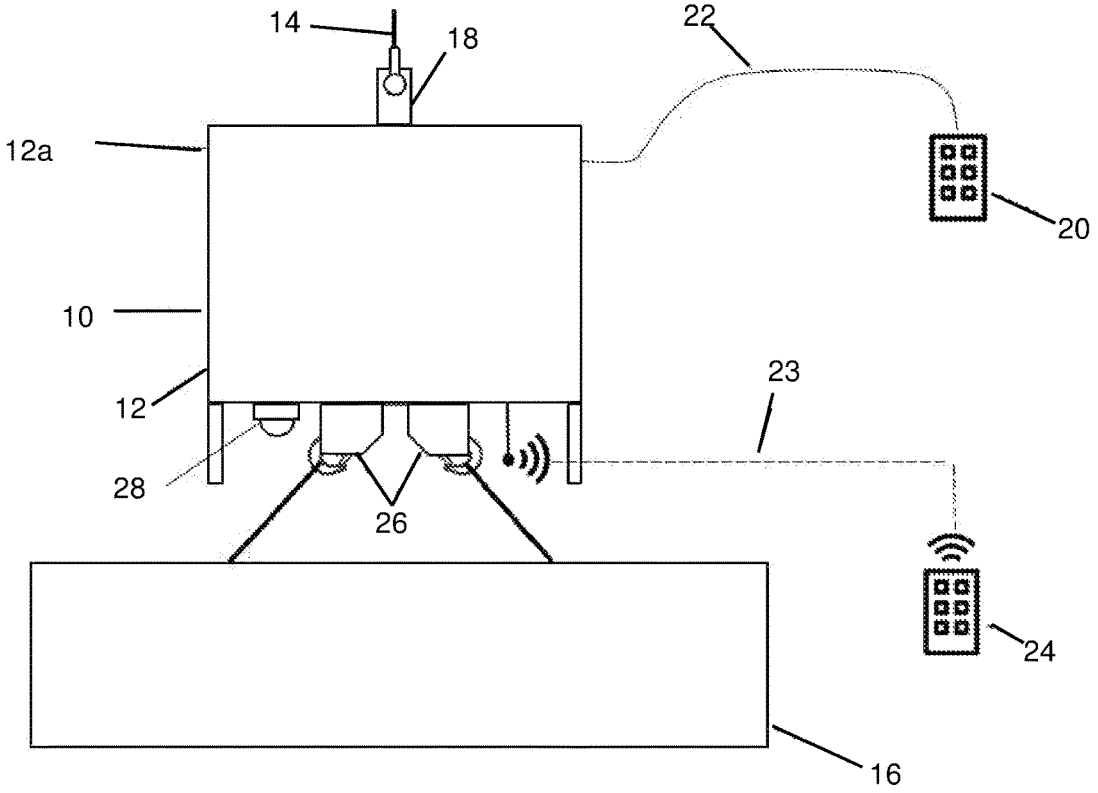
FIG. 1 shows a diagrammatic view of an exemplary embodiment of the present invention.

FIG. 1 shows a diagrammatic representation of an embodiment of the present invention.

A suspended payload orientation control apparatus 10 includes a rotator 12 including a housing 12*a* connected between a suspension line 14 (such as a cable) and a suspended payload 16.

The apparatus rotator is connected to the suspension line by a swivel device 18 permitting rotation of the apparatus (and therefore also the suspended payload) relative to the suspension line, and importantly, the lifting device and supporting infrastructure/vehicle—not shown).

The apparatus 10 can include control from a cable 22 connected controller 20 and/or by wireless communication 23 from a wireless remote controller 24, such as a handheld controller providing left-right rotation command input control means. One or both of the controllers 20 and 24 may also be used to display data received from the apparatus 10.

At least one remotely actuated load attachment means 26 (such as one or more remotely actuated release hooks) can be provided which can disconnect the device from the suspended load 16, for example, on the command of a signal received by the respective wireless or cable communicating controller 20, 24.

Figure 2:
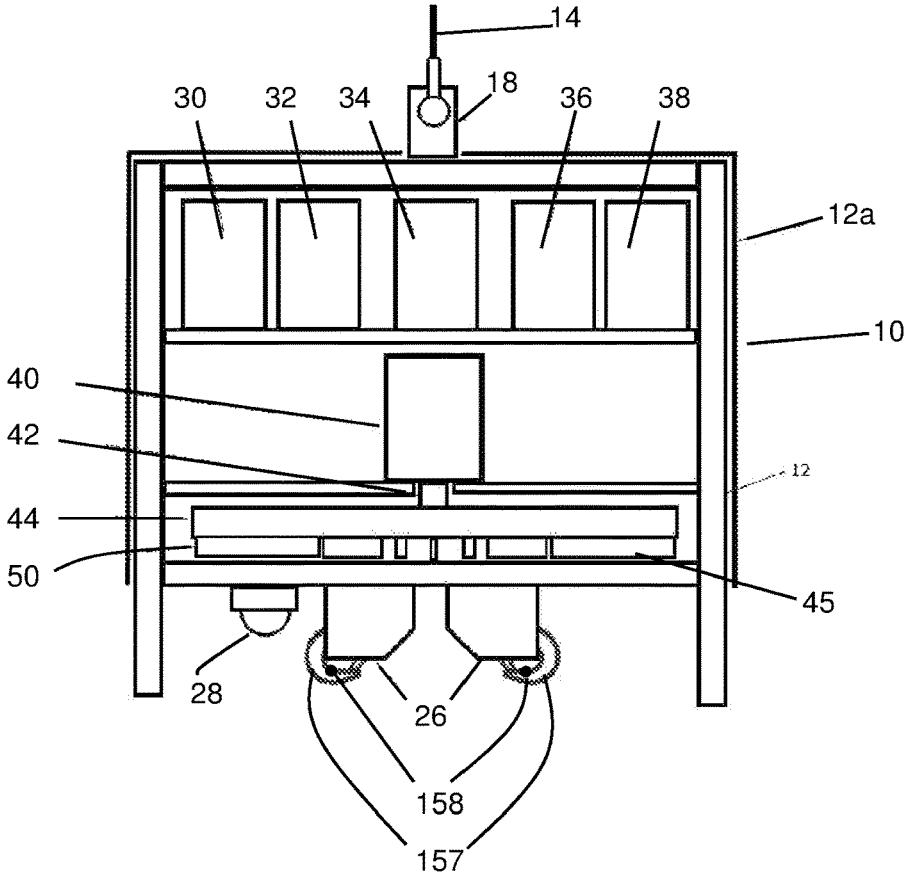
FIG. 2 shows a diagrammatic view of an exemplary embodiment of the present invention.

The suspended load 16 can be visually monitored by one or more optional cameras 28 (FIG. 2).

FIG. 2 shows an exemplary embodiment of the present invention in which the apparatus 10 includes a rotator 12 incorporating a variable speed motor controller 30, an input power inverter 32, a battery 34, a control module 36 and an optional battery charger 38.

A motor 40 drives a flywheel 44 via drive means 42. The drive means may be direct drive or may include a variable drive ratio means, such as a gearbox.

The rotator 12 is suspended from a suspension line (such as a cable) by a swivel 18, and the payload is attached to the rotator by one or more attachment means 26.

The apparatus can include at least one fan 45, such as one or more vane fans, which may be separate from, alternative to or integrated with a flywheel. The vane fan or each vane fan can include a number of fan vanes 50, 150. Air moved by the fan(s) provides a reaction force creating a reaction torque on the fan(s) and therefore on the associated flywheel(s), which is particularly effective at high flywheel rotational speeds augmenting or replacing a change of flywheel speed to induce reaction torque to control the rotational orientation of the payload.

For example, one or more of the provided flywheels 44, 144 may incorporate a number of vanes 50, 150 which may preferably include, or be, radial vanes.

The vanes allow the respective flywheel to perform in the manner of a centrifugal fan. This allows the motor 40 to continuously deliver a torque to the flywheel or to each respective flywheel without the flywheel(s) having to accelerate or decelerate—i.e. to increase or decrease the flywheel's angular velocity.

The air discharged from the periphery of the fan may be directed by a set of movable vanes to provide additional rotational torque to the suspended load. The moveable vanes may be mounted on the fan or may be mounted off the fan to guide airflow from the fan. The vanes may automatically adjust to change the direction of air deflection when the rotation direction of the fan reverses.

Figure 3:
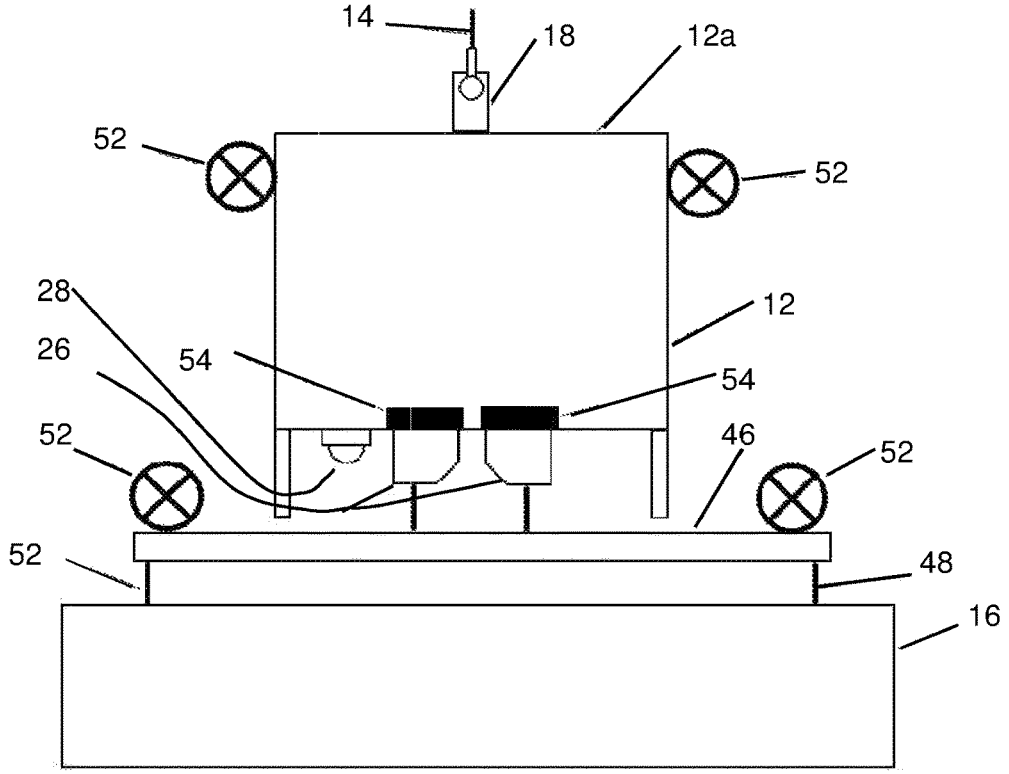
FIG. 3 shows a diagrammatic view of an alternative exemplary embodiment of the present invention.

As shown in the exemplary embodiment provided in FIG. 3, a further additional capability can be provided by thrusters 52.

The thrusters can be mounted external to a housing 12*a* of the rotator 12 to provide additional rotational thrust on the suspended load 16.

The thrusters could be mounted on the outside of the rotator housing 12*a* or can be mounted independently on a lifting device 46 (such as a lifting beam) attached to the rotator 12 or the thrusters 52 could be attached to the suspended load, or a combination thereof. Operation of the thrusters can be controlled by the controller 20, 24 via the control module 36.

The thrusters can include one or more of a propeller, a turbo fan, a shrouded fan or compressed gas jet thruster, or combinations of two or more thereof.

The apparatus may include at least one gyroscope, preferably two gyroscopes, to provide additional torque about a vertical or horizontal axis by tilting their respective axis of spin.

The apparatus can include at least one load cell 54 such that the weight of the lifted load and/or balance of weight between lifting points is provided to the remote operator and to the control system.

One or more cameras 28 can broadcast visual information to the remote operator to provide assistance in aligning the suspended load e.g. for alignment with a location to which the load is to be delivered.

The control system can include a) a microcomputer; b) a 9 axis inertial sensor containing accelerometers, gyros and magnetometers for each of the 3 principal axes x,y,z; c) an encoder input that senses the flywheel speed; d) interface to a motor variable speed controller; e) wireless (e.g. Wi-Fi, Bluetooth or other wireless means) interface; f) interface to load cell (if a load cell is used); g) interface to remote release hooks (if provided); h) interface to thrusters (if used); i) interface to centrifugal fan air guide vanes (if used), j) GPS sensor(s) (if used).

The apparatus can include adaptive control logic to allow the suspended load to be rotated to a yaw orientation defined by the operator and to maintain the load in that orientation. Maximum rotational speed can be controlled. The apparatus can adapt the applied torque according to the inertia of the load and the desired speed or rate of rotation. Rotational speed of the apparatus, or an applied torque according to the inertia of the load, or a desired speed or rate of rotation, or combination of two or more thereof, can be controlled by the adaptive control logic. The adaptive control logic can utilise at least one input from at least one sensor and/or integrating with at least one control means implementing the control logic. One or more sensors may include a position sensor, a rotary encoder, an accelerometer, a gyroscope, a magnetometer, angle/inclination sensor, temperature sensor, or a combination of any two or more thereof.

One or more of the hooks 157 may incorporate a groove or recess 158 laterally across the bend of the hook e.g. between the shank and the tip of the hook. The groove or recess can positively locate a connector (such as a shackle or link) supporting/connecting the load from the hook and restricting or preventing rotation between the hook and the connector (e.g. link or shackle.)

The apparatus preferably includes safety features that include a continuous 'heartbeat' or 'handshake' signal to verify communication with the remote control station and provide appropriate responses to prevent unwanted actions in case of loss of communication.

Figure 4:
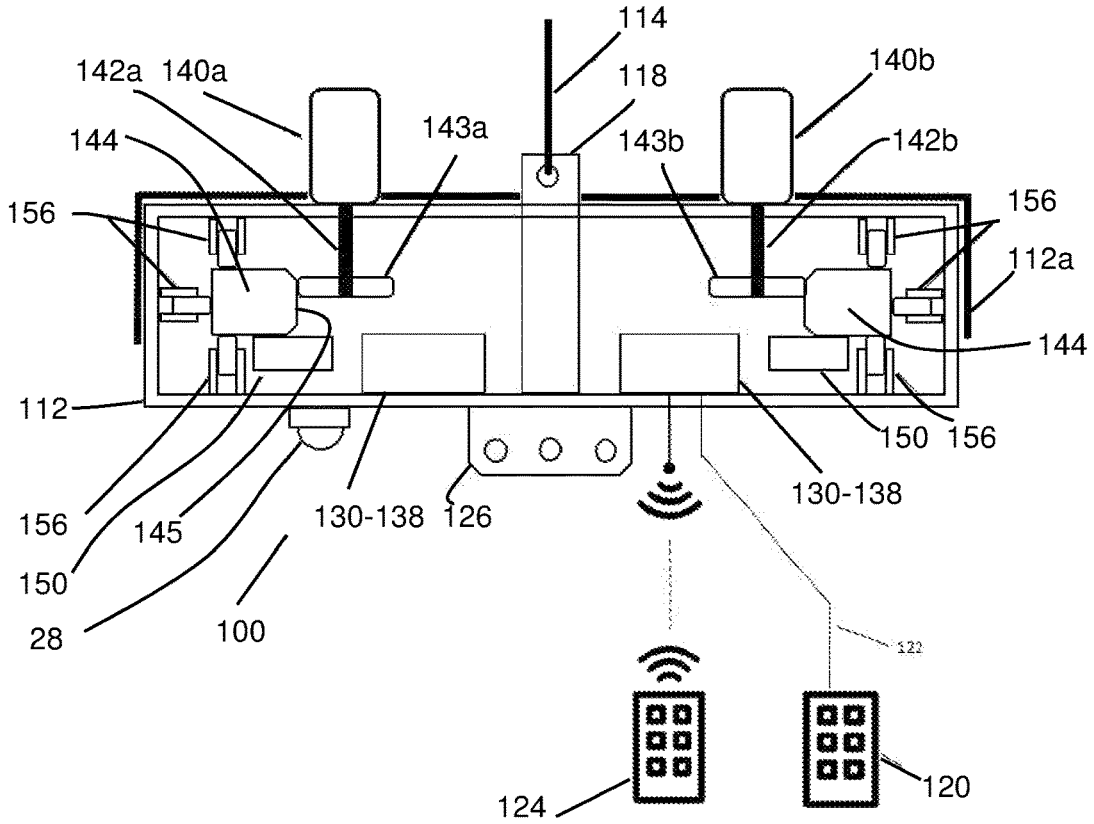
FIG. 4 shows a diagrammatic view of an alternative embodiment of the present invention.

As shown in FIG. 4, an alternative embodiment of the apparatus 100 includes a centreless, annular or ring flywheel 144 supported for rotation within the housing 112*a* by bearings 156. The bearings can be provided below, above and to the outer periphery of the flywheel. Alternative arrangements of bearings are envisaged, such as just lower and outer periphery bearings.

The flywheel 144 is preferably driven to rotate by at least one motor 140 (e.g. motors 140*a* and 140*b*), such as through respective drive means 142*a*, 142*b* and associated drive gears 143*a*, 143*b*, which may drive a ring gear on the inner face of the flywheel or may contact the inner face of the flywheel with drive wheels e.g. wheels of a resilient material such as rubber or other polymer. The flywheel 144 (which may be a ring type flywheel) may be driven directly by a direct drive motor connected to directly drive the flywheel or to a drive arrangement operatively connected to transfer drive from a motor to the flywheel, such as via a drive belt or chain. The flywheel may include vanes 150.

It will be appreciated that the gear ring can be provided on the outer face of the flywheel, and the drive to the gear ring provided externally of the flywheel, and the bearings arranged to support the lower/upper faces and the inner face Equipment—such as a battery, motor controller, inverter, control system, and optionally a battery charger (e.g. 130-138) can be provided within or on the housing 112*a*.

Figure 5:
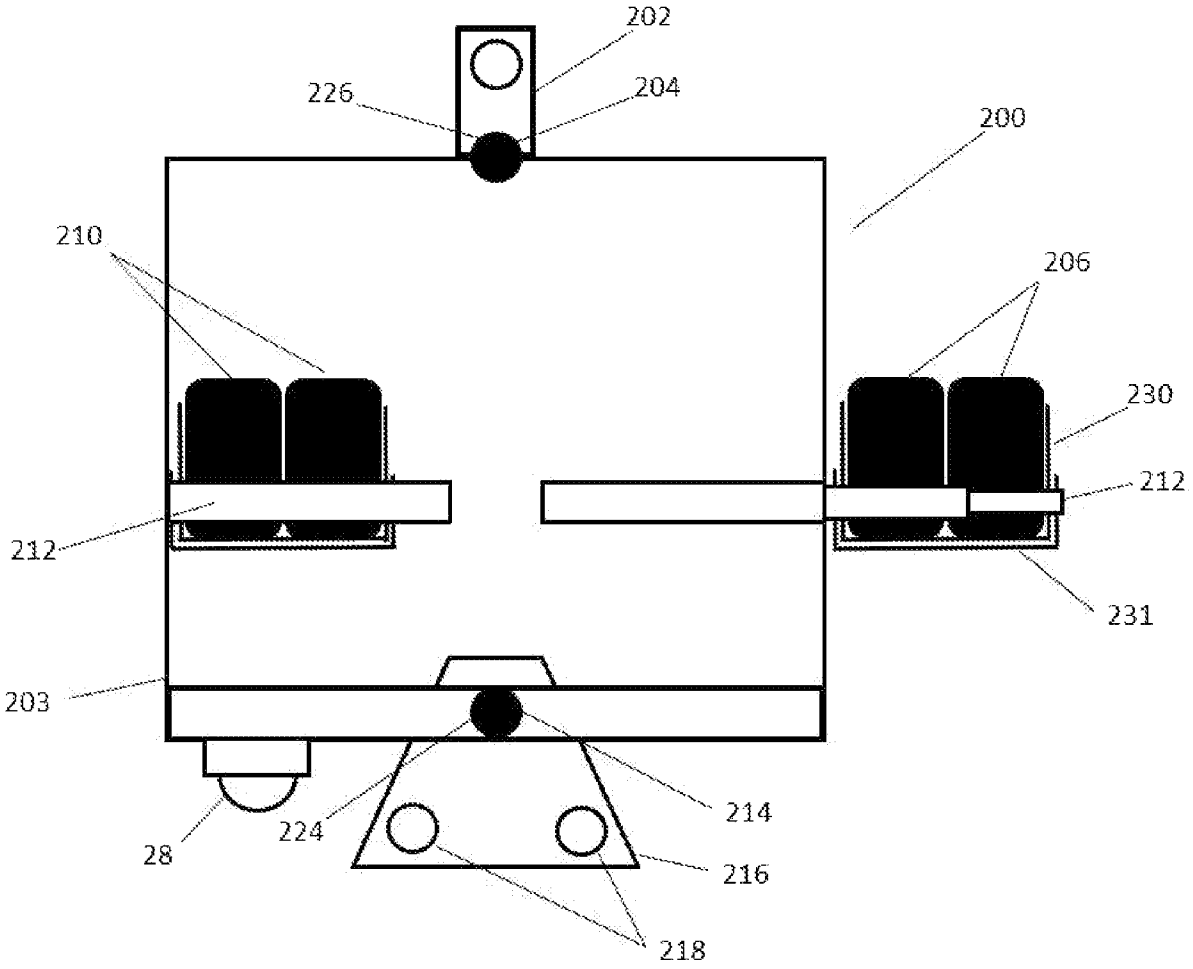
FIG. 5 shows an alternative embodiment of the present invention.
Figure 6:
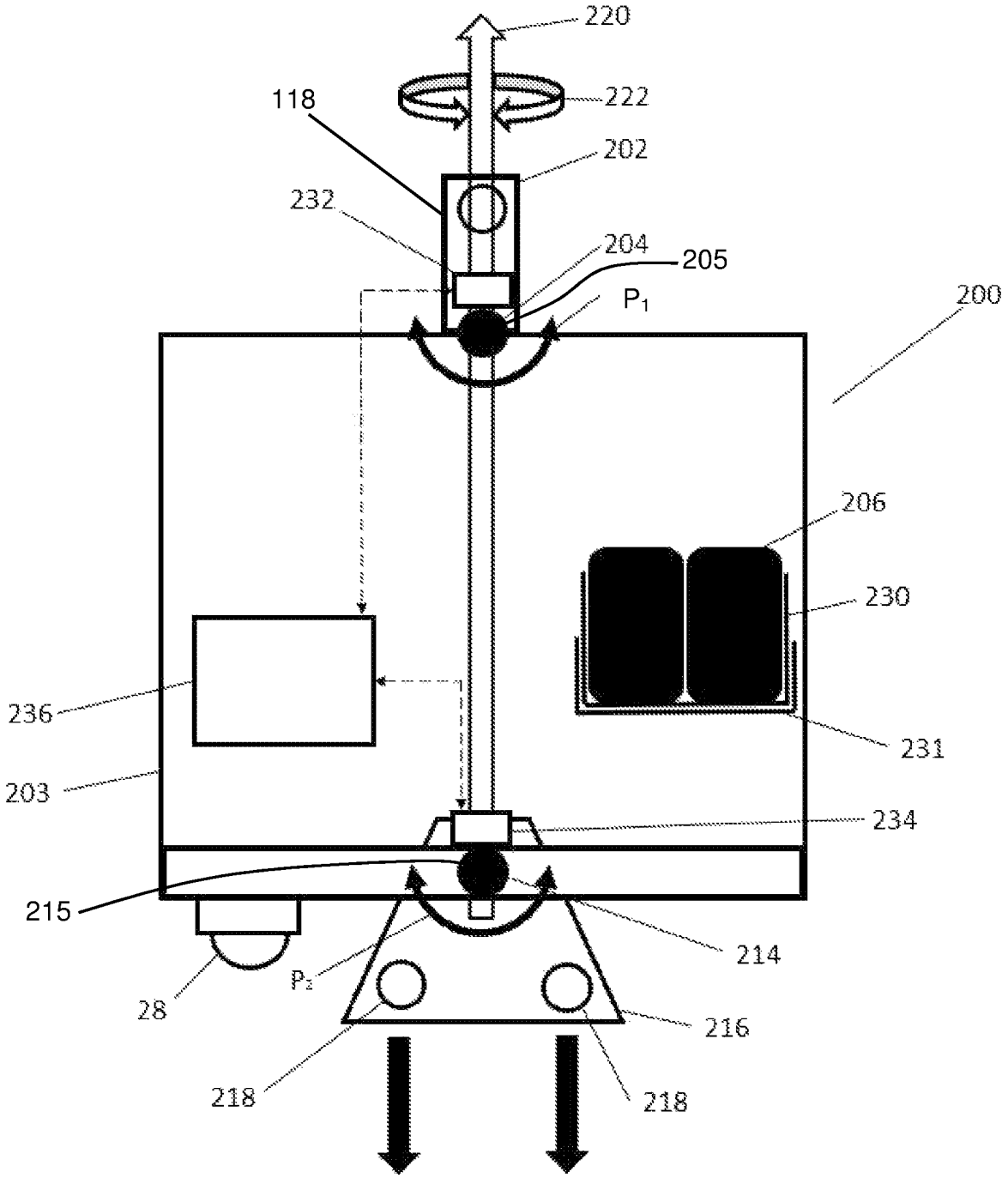
FIG. 6 shows another embodiment of the present invention.

FIGS. 5 and 6 show an apparatus 200 embodying the present invention.

The apparatus can include replaceable or rechargeable batteries 206, 210, such as within in a removable container 230, preferably supported by at least one drawer 231, which drawer may be mounted on telescopic drawer slides 212. The replaceable or rechargeable batteries 206, 210 can be provided as a cassette arrangement whereby the batteries plug in and are removable as a unit.

A swivel 118 can connect the body 203 to the suspension line, such as a cable or chain.

The swivel permits the body (and any suspended load) to rotate about a swivel axis 222, thereby allowing the entire body to rotate relative to the suspension line attached to the swivel.

An attachment part 202 can connect to the body 203 of the rotator via a respective pivot 204. The pivot allows pivoting motion ($P_1$) of the body about a pivot axis 205 relative to the attachment part by which the apparatus is supported from a cable or chain, such as of a crane. A load support 216, such as a spreader bar or frame, can be connected to the body 203 by a pivot 214, which allows pivoting motion ($P_2$) about a pivot axis 215 of the load relative to the body of the apparatus. For example, the pivots 204, 214 allow the body 203 to rotate more freely when the load is connected, such as when the device rotational axis (e.g. for the swivel) is not precisely vertical. At least one of the pivots can allow the rotator to tilt about the respective pivot axis relative to the load and there is little or no moment on the rotator about an axis perpendicular to the rotation axis of the rotator. For example, the pivot axis of the pivot between the rotator and the load can allow the rotator (e.g. a lower pivot) to tilt whilst the load remains suspended at or near horizontal. Alternatively, or in addition, the pivot between the suspension line and the rotator (e.g. upper pivot) can allow the body to tilt. More preferably, a combination of such upper and lower pivots allows the rotator to tilt relative to both the suspension line and the load, which allows for torque and precession effects, and allows the rotator to compensate for titling effects, such as cause d by winds, and to rotate more freely than would otherwise be the case. The upper and lower pivots are preferably parallel to one another.

The rotator 200 can be suspended from a suspension line (such as a cable) by an attachment, and the payload is attached to the rotator by one or more attachment means 26. The pivot 204 supporting the apparatus and/or the pivot 214 supporting the load can allow tilting through a respective pivot axis 205, 215 (e.g. a horizontal axis into-out of the page in the embodiment shown in FIG. 6) such that the axis of the swivel passes through a centre of gravity of a mass supported by the swivel 220 (see arrow 220 FIG. 6). A load can be attached to the apparatus via one or more attachment points 218.

The apparatus can have or communicate with a control system 236 using or in communication with at least one load cell 232, 234. The control system can use at least one signal from the load cell to determine whether to prevent the load from being disconnected if a load greater than a preset load is being supported by the apparatus. A load cell can be provided above or within or below the body. The apparatus may collect data relating to each lift that may include the lift weight, an image of the lift, the time of lift, location of lift (such as by using GPS and/or other data), that can be used for logistics tracking of the loads. The apparatus may have on-board memory for storage of data which includes the data described above. The apparatus may have a wireless connection to a remote or internet connected storage.

The apparatus may have a connection to an external or internal data storage that allows data collected by one or more of the load cell(s), camera(s) and GPS sensor(s) to be stored and retrieved, or stored on an internet connected device.

| Ref No. | Feature |
|---|---|
| 10, 100 200 | Suspended payload orientation control apparatus |
| 12, 112 | Rotator |
| 12a, 112a | Housing |

-continued

| Ref No. | Feature |
|---|---|
| 14, 114 | Cable |
| 16 | Payload |
| 18, 118 | Swivel coupling |
| 20, 120 | Controller (wired) |
| 22, 122 | Controller cable |
| 24, 124 | Controller (wireless) |
| 26, 126 | Load attachment means (optionally remotely releasable) |
| 28 | Camera(s) |
| 30, 130 | Variable speed motor controller |
| 143 | Drive gear |
| 145 | Ring gear on centreless, annular or ring flywheel |
| 45 | Fan |
| 202 | swivel |
| 222 | Swivel rotation |
| 205 215 | Pivot axes |
| 218 | Load attachment points (such as for a hook, strap, spreader bar etc.) |
| 32, 132 | Power inverter |
| 34, 206 | Battery/batteries |
| 36, 136 | Control module |
| 38, 138 | Battery charger (optional) |
| 40, 140 | Motor (preferably electric) |
| 42, 142 | Motor to flywheel drive means |
| 44, 144 | Flywheel Centreless, annular or ring flywheel |
| 46 | Load beam |
| 48 | Load beam to load connectors |
| 50, 150 | Fan vanes |
| 52 | Thrusters |
| 54, 232, 234 | Load cell(s) |
| 156 | Bearings |
| 157 | hook |
| 158 | Groove/recess in hook |
| 220 | Swivel axis |
| 204 214 | pivots |
| P1, P2 | Pivot rotation |

The invention claimed is:

1. A rotational orientation control apparatus for controlling rotational orientation of a load suspended from the apparatus, the apparatus including a rotator having at least one flywheel including at least one fan having vanes, at least one respective flywheel drive means, and a control means, wherein the control means is configured to control rotation of the at least one flywheel to provide a respective proportion of reaction torque, and wherein, in use, the vanes of the at least one fan create a reaction torque augmenting or replacing a change of speed of rotation of the at least one flywheel for controlling rotational orientation of a suspended load such that the flywheel drive means is able to continuously deliver a torque without the respective flywheel having to accelerate or decelerate.

2. The apparatus according to claim 1, wherein the reaction torque provided by the at least one fan augments or replaces a change of flywheel speed to induce reaction torque to control the rotational orientation of the suspended load.

3. The apparatus according to claim 1, further including at least one gyroscope.

4. The apparatus according to claim 1, including a controller connected by a data cable or wirelessly to communicate with the control means.

5. The apparatus according to claim 1, including at least one camera for monitoring the suspended load and/or the physical space around the suspended load or location below the suspended load and/or for collecting one or more images and/or data relating to the apparatus or the suspended load.

6. The apparatus according to claim 1, including a remotely actuated load release mechanism.

7. The apparatus according to claim 6, the remotely actuated load release mechanism including at least one hook or retractable pin.

8. The apparatus according to claim 1, including at least one moveable said vane to modify/control airflow from one or more respective fans.

9. The apparatus according to claim 1, further including at least one thruster.

10. The apparatus according to claim 9, the at least one thruster mounted external of a housing of the rotator or mounted independently on a lifting device attached to the rotator or attached to the suspended load.

11. The apparatus according to claim 9, operation of the at least one thruster being controlled by a remote controller.

12. The apparatus according to claim 9, wherein the at least one thruster includes one or more of a propeller, a turbo fan, a shrouded fan or compressed gas jet thruster, or combinations of two or more thereof.

13. The apparatus according to claim 1, including at least one gyroscope providing torque about a vertical axis by tilting their respective gyroscope axis of spin.

14. The apparatus according to claim 1, including at least one load cell.

15. The apparatus according to claim 1, including a control system, the control system including one or more of a) a microcomputer; b) a 9 axis inertial sensor containing accelerometers, gyros and magnetometers for each of the 3 principal axes x,y,z; c) an encoder input that senses the flywheel speed; d) interface to a motor variable speed controller; e) wireless interface; f) interface to load cell; g) interface to remote release; h) interface to thrusters; i) interface to centrifugal fan air guide vanes, and j) one or more GPS receivers.

16. The apparatus according to claim 1, including adaptive control logic allowing the suspended load to be rotated to an orientation defined by the operator and to maintain the load in that orientation.

17. The apparatus according to claim 16, wherein the adaptive control logic enables the suspended load to be rotated to a yaw orientation defined by an operator and to maintain the load in that yaw orientation.

18. The apparatus according to claim 16, wherein a rotational speed of the apparatus, or an applied torque according to the inertia of the load, or a desired speed or rate of rotation, or combination of two or more thereof, is controlled by the adaptive control logic.

19. The apparatus according to claim 16, including the adaptive control logic utilising at least one input from at least one sensor and/or integrating with at least one control means implementing the control logic.

20. The apparatus according to claim 1, wherein the at least one flywheel includes an annular or ring type flywheel.

21. The apparatus according to claim 20, wherein the annular or ring type flywheel is driven through an internal or external ring gear of the flywheel.

22. The apparatus according to claim 1, including or in control communication with an adaptive control system arranged and configured to respond to or react to increasing rotational stiffness of a support system as rotational torque increases.

23. The apparatus according to claim 1, wherein the at least one flywheel includes an annular or ring type flywheel driven through an internal or external ring gear of the flywheel or driven using a belt or chain connected to the flywheel.

24. The apparatus according to claim 23, wherein the annular or ring type flywheel is driven by a motor with a hollow centre, and wherein the annular or ring type flywheel allows the main load carrying element connecting the load and a lift line to pass through the hollow centre.

25. The apparatus according to claim 23, including at least one bearing supporting the annular or ring type flywheel on an inside of an annulus or adjacent to the inside of the annulus by attaching to a main load carrying element that supports the load and transmits torsional forces to the load.

26. The apparatus according to claim 1, including a rotational swivel and a single point attachment that connects multiple lifting points, wherein a projection of an axis of the rotational swivel passes through the single point attachment.

27. The apparatus according to claim 26, wherein the rotational swivel is tiltable such that the axis of the swivel passes through a centre of gravity of a mass supported by the rotational swivel.

28. The apparatus according to claim 1, including at least one pivot, each said pivot having a pivot axis, and wherein the at least one pivot is connected between the rotator and a suspension line from which the rotator is suspended and/or at least one said pivot connected between the rotator and a load suspended from the rotator.

29. The apparatus according to claim 28, wherein the at least one pivot allows the rotator to tilt about the respective pivot axis relative to the load suspended from the rotator and there is no moment on the rotator about at least one axis perpendicular to a rotation axis of the rotator.

30. The apparatus according to claim 28, wherein the pivot axis of at least one said pivot connected between the rotator of the apparatus and a suspension line from which the rotator is suspended and a pivot axis of the at least one said pivot connected between the rotator and a load suspended from the rotator are parallel to one another.

31. The apparatus according to claim 1, including a control system using or in communication with a load cell, the control system using at least one signal from the load cell to determine whether to prevent the load from being disconnected if a load greater than a preset load is being supported by the apparatus.

32. The apparatus according to claim 1, further including at least one plug in or slide in cassette for supporting connection of at least one component of the apparatus.

33. The apparatus according to claim 32, including at least one said plug in cassette or slide in cassette for mounting at least one battery or a combination of a plug in or slide in cassette contained in a removable container.

34. The apparatus according to claim 1, including image and/or data capture means, wherein the captured image(s) and/or data relate to a lifted load.

35. The apparatus according to claim 34, wherein the captured image(s) and/or data is/are stored on-board the apparatus or on a remote computer.

36. The apparatus according to claim 1, including at least one hook including a groove or recess to receive and restrict rotation of a shackle or link connected to a suspended load that is supported, in use, by the respective hook.

37. The apparatus according to claim 36, wherein the groove or recess is provided at a widened/thickened portion of the bend of the hook, and wherein the bend of the hook has a portion that widens/flares outwards such that a base of the recess or groove is wider than portions of the hook immediately prior to and/or after the flared portion.

38. The apparatus according to claim 1, including a control system that utilises measured load to adapt parameters for determining torque to be applied to the load.

* * * * *